United States Patent [19]

Freeman

[11] 4,377,487

[45] Mar. 22, 1983

[54] METAL COATING PROCESS AND COMPOSITIONS

[75] Inventor: Dennis B. Freeman, North Harrow, Great Britain

[73] Assignee: Occidental Chemical Corporation, Warren, Mich.

[21] Appl. No.: 86,509

[22] Filed: Oct. 19, 1979

[30] Foreign Application Priority Data

Oct. 31, 1978 [GB] United Kingdom ..... 42675/78

[51] Int. Cl.[3] ..... C10M 1/40

[52] U.S. Cl. ..... 252/33.4; 72/42; 252/46.4; 252/49.3; 252/49.5

[58] Field of Search ..... 252/49.5, 49.3, 33.4, 252/46.4; 72/42

[56] References Cited

U.S. PATENT DOCUMENTS 3,408,843 11/1968 Great ..... 252/49.5
3,523,895 8/1970 Ishibashi et al. ..... 252/49.5

FOREIGN PATENT DOCUMENTS 1408702 10/1975 United Kingdom ..... 252/49.3
1421386 1/1976 United Kingdom ..... 252/49.5

*Primary Examiner*—Andrew Metz
*Attorney, Agent, or Firm*—Richard P. Mueller

[57] ABSTRACT

A composition for forming a phosphate and lubricant coating in a single operation comprises phosphate ions, metal ion other than alkali metal, lubricant particles, cationic emulsifier and a scale prevention additive comprising a naphthalene sulphonic acid/formaldehyde condensation product.

16 Claims, No Drawings

METAL COATING PROCESS AND COMPOSITIONS

BACKGROUND OF THE INVENTION

It is well known to form coatings on metal surfaces to serve as a base for lubricants and/or to give corrosion resistance or paint adhesion by treating the metal with a phosphate solution. It is equally well known that a problem of such processes is that a tightly adherent scale of metal phosphates tends to build up in the apparatus being used. If scale does form, the process is still operable but is less economical. Numerous attempts to prevent this adherent scale have been made, often involving the addition of various additives, such as polyacrylamides and carbohydrates, to the treatment solution. Only some of these attempts have been successful. British Pat. Specification Nos. 1,257,947, 1,408,702, and 1,412,135 are amongst the many disclosures of such attempts.

When the metal surface needs to have a lubricant composition applied to it to facilitate cold working operations such as drawing it is customary to apply the lubricant after applying the phosphate coating but it has been proposed to form the phosphate coating and apply the lubricant in a single step. Such a process, and compositions for it, are described in British Pat. Specification No. 1,421,386. Such compositions already include relatively large amounts of cationic surfactant. Despite the presence of these surfactants and that, as described therein, the solution scavenges the sludge forming materials that normally form in phosphating solutions a fundamental difficulty with processes of the type described in Specification No. 1,421,386 is that a tightly adherent wax scale forms on the apparatus being used. It seems probable that some form of reaction occurs between the metal of the apparatus and the fatty component of the lubricant but whatever the mechanism the result is that a scale is formed. This scale chemically is very different from the phosphate scale described above in that it includes large amounts of tightly adherent fatty material. Although it might be expected that emulsifiers and surfactants would inhibit the scale, it is formed despite the presence of large amounts of emulsifier and the addition of further emulsifier or common surfactants does not prevent its formation. Despite the theoretical advantages of the process of Specification No. 1,421,386 and despite attempts at avoiding the scale problem, scale formation has proved to be such a problem that the process is commercially impracticable.

SUMMARY OF THE INVENTION

We have now discovered that this scale formation problem can be overcome if the composition and process of Specification No. 1,421,386 are modified by the inclusion of a naphthalene sulphonic acid/formaldehyde condensation product or salt thereof.

A phosphate coating solution according to the invention contains phosphate ions, non-alkali metal ion emulsified lubricant particles, the lubricant being selected from the group consisting of $C_8$ to $C_{40}$ carboxylic acids and alcohols including the esters, mono and polyamide salts, mono and polyalkyl ($C_1$–$C_{18}$) amine salts thereof as well as mixtures thereof, and a scale prevention additive which is a naphthalene sulphonic acid/formaldehyde condensation product or a salt thereof.

The invention also includes concentrates suitable for dilution to form such a phosphate coating solution and methods of providing a corrosion inhibiting and lubricant coating on a metal article comprising contacting the article with the phosphate coating solution.

DETAILED DESCRIPTION OF THE INVENTION

In accordance with the present invention, the aqueous acidic composition contains at least about 0.2 wt. % phosphate ions, from about 0.3 to about 16 wt. % of an emulsified organic lubricant, about 0.1 to about 10 wt. % of the emulsifier, at least about 0.1 wt. % of non-alkali metal ions, from about 0.05 to about 5 wt. % of the scale prevention additive and water.

The scale prevention additives used in the invention are anionic high molecular weight compounds and it is surprising that they can be used satisfactorily in combination with the cationic surfactants that are present in the composition in any event. The condensation product is usually provided as a salt, usually the sodium or other alkali metal salt, but will generally be present in the solution as acid. The additive will be present in the solution in dissolved form. When a concentrate is prepared initially the additive is usually present in it in dissolved form.

Preferred materials are compounds of the formula:

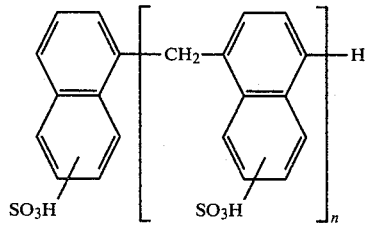

where n is a number from 2 to 8 inclusive, and alkali metal or other soluble salts thereof, preferably the sodium salt.

A particularly preferred material is that sold by Ciba-Geigy (UK) Limited under the registered Trade Mark "Belloid", for example "Belloid" SFD.

The amount of condensation product that is added is generally from 1 to 10% by weight based on non-aqueous ingredients in the composition. In the preferred treatment solutions the amount of additive is generally from 0.5 to 10 g/l whilst in the preferred concentrates, which may contain from 10 to 30% solids with the balance water, the amount of additive may be from 0.5 to 5% by weight. The additive may be added direct into the treatment solution or may be included in a concentrate containing all the ingredients of the treatment solution and which merely has to be diluted in water.

Apart from the described additive the compositions and methods may be as described in British Pat. Specification No. 1,421,386.

The lubricant constituent of the bath comprises an organic emulsifiable carboxylic acid and/or alcohol containing from 8 to 40 carbon atoms as well as esters, mono and polyamine and/or mono and polyalkyl ($C_1$–$C_{18}$) amine salts as well as mixtures thereof. The lubricant constituent may be of saturated or unsaturated form and of a natural or synthetic origin.

Suitable saturated long chain fatty acids include lauric, stearic and palmitic acids. Suitable long chain fatty acid esters include fatty glycerides, lanolin soaps and alcohols. The preferred ester component is blown sperm oil. In preparing the composition of the invention for use in industry a blend of natural and synthetic esters will normally be used and which contains less costly components e.g. up to 20% of paraffin wax, slack wax, synthetic waxes or hydrocarbon wax.

The lubricant particles are emulsified with a cationic emulsifier. Stable emulsions may be obtained in acid phosphate solutions using emulsifiers such as fatty amines and ethoxylate fatty amines preferably containing from 2 to 20 moles of ethylene oxide in the ethoxylated chain. The proportion of emulsifier required to form a suitable emulsion depends on the proportion of lubricant in the coating solution. When provided as a concentrate in which the content of wax is between 5 and 20%, the amount of cationic emulsifier will normally be between 3 and 15%.

The phosphate ion constituent of the bath can be suitably introduced in any soluble form such as concentrated phosphoric acid.

The phosphate coating solution or concentrate preferably includes zinc ions as non-alkali metal, and when prepared as a concentrate may suitably comprise a 5 to 20% aqueous solution of phosphoric acid in which from 0.1 to 1.0% of the metal other than an alkali metal has been dissolved.

In addition to the non-alkali metal ions, the bath and concentrate may further contain corrosion inhibitors, chelating agents and conventional accelerators and activators as well as pH adjusters of the types and in the concentrations conventionally employed which are compatible with and do not adversely affect the stability of the emulsion. Generally, the inclusion of such supplemental additives is not necessary to achieve satisfactory coating results.

A corrosion inhibiting lubricant coating can be formed on an article by contacting the article with the coating solution in a single state coating process, thereby avoiding the traditional need to use a multistage process.

The operating bath can be employed at temperatures ranging from ambient temperature up to about 200° F. with temperatures of from about 120° F. to about 160° F. being particularly satisfactory. The coating bath composition can be applied to the metal surface by flooding, immersion, spraying, and the like, of which immersion is preferred, so as to provide intimate contact therebetween. To maintain bath uniformity, the bath is preferably agitated. The duration of the contact time will vary depending upon the composition of the coating composition, the concentration thereof, the temperature of application, and the desired coating weight required in consideration of the severity of the metal forming operations to which the articles are to be subjected. Ordinarily, contact times employing an immersion technique of from about one minute up to about twenty minutes is satisfactory. The coating formed comprises a phosphate coating having lubricant particles occluded therein or deposited thereon.

The coated articles at the conclusion of the contact time is subjected to a drying stage prior to metal forming. The drying step can be accomplished at temperatures ranging from ambient temperature up to about 350° F. with temperatures of from about 250° F. to about 350° F. being preferred due to the accelerated drying rate obtained. During the drying step at elevated temperature, the lubricant particles may coalesce into a film. Such coalescense, however, is not important in achieving satisfactory lubricant coatings in that solid particles dispersed in or on the phosphate coating also provide for satisfactory lubricity during subsequent metal working operations.

The metal articles prior to the coating operation are subjected, if necessary, to conventional precleaning treatments to remove contaminating substances and scale from the surfaces thereof providing for a clean surface.

The operating bath may range in acidity from a lower pH value at which excessive acid pickling begins to occur to an upper pH value at which insufficient bath reactivity begins to occur, preventing formation of a satisfactory coating. Usually, a pH ranging from about 2.4 to about 3.4 is satisfactory while a pH ranging of from about 2.8 to about 3.1 is preferred.

The following are examples, Example 1 being comparative.

EXAMPLE 1

| | |
|---|---|
| A concentrate was formed of: | |
| Stearic acid | 34.4 kg |
| "Duomeen" TDO | 24.0 |
| "Polyram" S | 24.0 |
| Glycerol monostearate | 32.0 |
| Phosphoric acid (100%) | 68.0 |
| Zinc Oxide | 5.6 |
| Water to | 1,000 kg |

"Duomeen" is a trade mark and "Duomeen" TDO is N-tallow trimethylene diamine dioleate. "Polyram" is a trade mark and "Polyram S" is polyaminoethoxylate cationic surfactant.

A 25% by weight solution in water of the above concentrate was formed. It was maintained at 80° C. and steel panels were coated by immersion in this. After treating 0.2 square meters of steel panel per liter of solution a soft wax like deposit built up on the heating coil, within about 3 days, and could not be washed off and prevented maintenance of the chosen working temperature.

EXAMPLE 2

The process of Example 1 was repeated except that 3.2 g/l "Belloid" SFD was added to the treatment solution. After treating 0.2 square meters per liter of solution there was no sign of any deposit and there was still no sign of scale on the heating coil after about 3 weeks at working temperature.

During use of the solution, solution concentration may be maintained by additions of the same or a different concentration as wax and acid compositions are used up proportionately during normal use. If necessary acid/zinc or wax emulsifiers can be added separately to maintain the performance. The coated articles have bright metal surfaces having excellent rust resistance even after metal working, for instance cupping or drawing, and only need degreasing prior to further treatment, such as for example painting.

What is claimed is:

1. In an aqueous acidic lubricant coating composition useful as is or when diluted with water for treating metal surfaces prior to metal forming operations, which composition is an aqueous emulsion which contains:

(a) at least about 0.2 wt. % phosphate ions;

(b) from about 0.3 to about 16 wt. % of an emulsified organic lubricant selected from the group consisting of $C_8$ to $C_{40}$ carboxylic acids and alcohols including esters, mono and polyamine salts, mono and polyalkyl ($C_1$–$C_{18}$) amine salts thereof as well as mixtures thereof;

(c) from about 0.1 to about 10 wt. % of a cationic emulsifying agent;

(d) at least about 0.1 wt. % of metal other than alkali metal ions; and (e) water, and is characterized by the formation therein, during use, of an adherent wax scale which builds up on the apparatus in which the composition is used, the improvement which comprises incorporating in said composition from about 0.05 to 5.0 weight % of at least one scale prevention additive selected from the group consisting of naphthalene sulfonic acid/formaldehyde condensation products and the alkali metal or ammonium salts thereof, which agent is effective in preventing the formation of said wax scale.

2. The composition as defined in claim 1 in which said $C_8$ to $C_{40}$ lubricant constituent is comprised of a major portion of $C_8$ to $C_{24}$ constituents.

3. The composition as defined in claim 1 containing:

(a) from about 1.5 to about 3 wt. % of said phosphate ions;

(b) from about 2 to about 6 wt. % of said lubricant;

(c) from about 0.5 to about 4 wt. % of said cationic emulsifying agent;

(d) from about 0.1 to 1.0 wt. % of metal ions other than alkali metal ions; and (e) from about 0.05 to 1.0 wt. % of said scale prevention additive.

4. The composition as defined in claim 1 having a pH of about 2.4 to about 3.4.

5. The composition as defined in claim 1 having a pH of about 2.8 to about 3.1.

6. The composition as defined in claim 1 in which said metal ions are selected from the group consisting of iron, zinc and mixtures thereof.

7. The composition of claim 1 in which the scale prevention additive is selected from the group consisting of compounds of the formula:

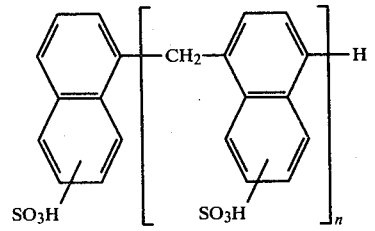

where n is an integer from 2 to 8 inclusive, and the soluble salts thereof.

8. The composition as defined in claim 1 additionally comprising a corrosion inhibitor compound.

9. The composition defined in claim 1 additionally comprising a chelating agent.

10. A method of treating a clean metal surface to form a lubricant coating thereon prior to metal forming operations which comprises the steps of contacting said surface with a composition as defined in claim 1 for a period of time sufficient to form a coating and thereafter drying said surface.

11. The method as defined in claim 10 in which said composition is at a temperature ranging from ambient temperature up to about 200° F.

12. The method as defined in claim 10 in which said composition is at a temperature of about 120° F. to about 160° F.

13. The method as defined in claim 10 in which the step of drying said surface is performed at a temperature ranging from ambient up to about 350° F.

14. The method as defined in claim 10 in which the step of drying is performed at a temperature ranging from about 250° F. to about 350° F.

15. The method as defined in claim 10 in which the step of contacting said surface with said composition is performed for a period ranging from about one to about 20 minutes.

16. The method as defined in claim 10 in which said composition is at a pH of about 2.4 to about 3.4.

* * * * *